US007913531B2

(12) United States Patent
Huang et al.

(10) Patent No.: US 7,913,531 B2
(45) Date of Patent: Mar. 29, 2011

(54) ROLL PROFILE FOR BOTH SHAPE CONTROL AND FREE RULED ROLLING

(75) Inventors: Haodong Huang, Liaoning Province (CN); Xianlin Chen, Liaoning (CN); Anrui He, Anshan (CN); Lin Zhao, Anshan (CN); Xiaochun Sha, Anshan (CN); Xu Yang, Anshan (CN); Xin Chen, Anshan (CN); Yanqiang Xu, Anshan (CN); Pusheng Ma, Anshan (CN); Xiaobo Guo, Anshan (CN); Haoran Dong, Anshan (CN); Shengtian Wu, Anshan (CN)

(73) Assignee: Angang Steel Company Limited, An Shan (CN)

( * ) Notice: Subject to any disclaimer, the term of this patent is extended or adjusted under 35 U.S.C. 154(b) by 800 days.

(21) Appl. No.: 11/909,263

(22) PCT Filed: Mar. 24, 2006

(86) PCT No.: PCT/CN2006/000508

§ 371 (c)(1),
(2), (4) Date: Sep. 20, 2007

(87) PCT Pub. No.: WO2006/099817

PCT Pub. Date: Sep. 28, 2006

(65) Prior Publication Data

US 2008/0163659 A1 Jul. 10, 2008

(30) Foreign Application Priority Data

Mar. 25, 2005 (CN) ..... 2005 1 0046113

(51) Int. Cl.
*B21B 39/20* (2006.01)

(52) U.S. Cl. ..... 72/252.5

(58) Field of Classification Search ..... 72/236, 72/237, 247, 252.5

See application file for complete search history.

(56) References Cited

U.S. PATENT DOCUMENTS

| | | | |
|---|---|---|---|
| 4,703,641 | A | 11/1987 | Yarita et al. |
| 4,881,396 | A | 11/1989 | Seidel et al. |
| 5,174,144 | A | 12/1992 | Kajiwara et al. |
| 5,875,663 | A | 3/1999 | Tateno et al. |
| 6,119,500 | A | 9/2000 | Ginzburg et al. |
| 2004/0003644 | A1 | 1/2004 | Hartung et al. |

FOREIGN PATENT DOCUMENTS

| | | | |
|---|---|---|---|
| EP | 0294544 | A | 12/1998 |
| JP | 6198313 | A | 10/1984 |

(Continued)

OTHER PUBLICATIONS

PCT ISR WO Jun. 22, 2006.

(Continued)

*Primary Examiner* — Teresa M Ekiert
(74) *Attorney, Agent, or Firm* — Schwabe, Williamson & Wyatt, P.C.

(57) ABSTRACT

The invention provides a roll profile for work rolls for both shape control and free ruled rolling. Each of the work rolls has a tapered end. The curve of respective tapered end is a quartic curve represented by a formula $y(x)=a_0+a_1x+a_2x^2+a_3x^3+a_4x^4$, $x\epsilon[0,Le]$, $y(x)\epsilon[0,He]$. It is possible to partially eliminate the asymmetric deformation due to the difference between abrasion of the upper and lower rolls. Further, closed type abrasion of conventional roll is changed into open type abrasion and box shaped abrasion of conventional roll is eliminated, which eliminating "cat ear" hole and fulfilling the requirements of free ruled rolling.

2 Claims, 2 Drawing Sheets

FOREIGN PATENT DOCUMENTS

| | | | |
|---|---|---|---|
| JP | 61144202 | A | 7/1986 |
| JP | 63264204 | A | 1/1988 |
| JP | 04288915 | | 10/1992 |
| JP | 08010816 | | 1/1996 |
| JP | 02865804 | B9 | 12/1998 |
| JP | 02928581 | B9 | 5/1999 |
| WO | 0119544 | A | 3/2001 |
| WO | 0211916 | A | 2/2002 |

OTHER PUBLICATIONS

European Patent Office, European Search Report, Dec. 16, 2008, 5 pages.

Office Action, mailed on May 11, 2010, for JP Patent Application 2008-502229, 5 pages.

--Prior Art--

ROLL PROFILE FOR BOTH SHAPE CONTROL AND FREE RULED ROLLING

FIELD OF THE INVENTION

The invention relates to a roll profile for work rolls for shape control in the continuous hot rolling, specialty a roll profile for both shape control and free ruled rolling.

DESCRIPTION OF THE RELATED ART

Nowadays, an effective method was used to control the strip shape, which is a technology for controlling the strip shape by shifting the roll with special profile, such as continuous Variable Crown CVC, Liner Variable Crown LVC, and Kawasaki-Work Roll Shifting K-WRS.

(1) CVC (Continuous Variable Crown) is provided by designing the roll profile as a cubic curve represented by formula (1) as follows, the upper and lower rolls are located anti-symmetrically. The shape controlling is accomplished by varying the crown of roll gap through axial shifting. The relation between the crown of roll gap of the unloaded roll and the width of strip is quadratic, while the relation between the crown of roll gap of the unloaded roll and the axial shifting amount of the roll is linear.

$$f(x)=a_0+a_1(x-\delta_0)+a_3(x-\delta_0)^3 \quad (1)$$

here:

x: the coordinate of the roll body;

$\delta_0$: the original shifting amount of the roll;

$a_0$, $a_1$, $a_3$: the coefficient of the roll profile.

(2) LVC (Linear Variable Crown) is provided by designing the roll profile as special curve represented by formula (2) as follows, the upper and lower rolls are located anti-symmetrically. The shape controlling is accomplished by varying the crown of roll gap through axial shifting. The relation between the crown of roll gap of the unloaded roll and the width of the strip is linear approximately, while the relation between the crown of roll gap of the unloaded roll and the axial shifting amount of the roll is linear.

$$f(x)=a_0+a_1(x-\delta_0)\sin(\alpha x)+a_3(x-\delta_0)^3 \quad (2)$$

here:

x: the coordinates of the roll body;

$\delta_0$: the original shifting amount of the roll;

$a_0$, $a_1$, $a_3$: the coefficient of the roll profile;

$\alpha$: the controlling coefficient of phase angle.

(3) K-WRS (Kawasaki-work roll shifting) is a kind of roll with linear tapered end. The marginal shape of the strip is controlled by axial shifting of the upper and lower rolls.

The length of the tapered end of the work rolls is in the range of 100~200 mm;

The height of the tapered end of the work rolls is in the range of 300~700 μm.

In hot rolling, the difference of the abrasion amount between the conventional upper and lower rolls leads to the difference of the roll profile between the upper and lower rolls. Under the stresses, the work rolls will generate asymmetric wedge loaded roll gap when the rolls shift axially, which bring huge difficulty to the running control and shape control in production. In the three type of roll profile mentioned above, CVC and LVC are used to control the shape of the central strip in width direction (which can be described as crown), while K-WRS is used to reduce the edge drop by entering the strip into the tapered end 40 mm~75 mm, which is great effective to the marginal shape control of strip in width direction. But the three types of roll profile cannot control the asymmetric defect of the shape of strip produced in production effectively. Moreover, the shifting amount of the CVC and LVC is determined by the target shape of the rolled strip in each pass and each framework, the shifting amount of the K-WRS is determined by the width of the rolled strip, so the three types of rolls mentioned above can not average the abrasion of the roll body, and the non-uniform abrasion of the roll body leads to the box shaped abrasive roll profile and "cat ear" abrasive roll profile (shown in FIG. 1). The abrasion characteristic of the types of rolls is same as that of the conventional rolls. In order to improve the utilization of the work rolls, we have to follow the narrow-broad-gradual narrow coffin-shaped rolling schedule. This type of rolling schedule can fulfill neither the flexible, small-lot rolling requirements, nor the requirements of the same width in continuous casting and rolling, so which can not realize the free ruled rolling.

SUMMARY OF THE INVENTION

Therefore the object of the invention is to provide a roll profile for work rolls for both shape control and free ruled rolling, which fulfils not only the flexible, small-lot rolling requirement, but also the requirement of the same width in continuous casting and rolling.

According the present invention, a roll profile for work rolls is provided for both shape control and free ruled rolling. Each of the work rolls is a roll having a tapered end. Providing starting point of the tapered end of the rolls being origin of coordinates, the curve of respective tapered end is a quartic curve represented by a formula as follows:

$$y(x)=a_0+a_1x+a_2x^2+a_3x^3+a_4x^4 \quad x\in[0,Le],\ y(x)\in[0,He]$$

here:

Le: the length of the tapered end of work rolls, in the range of 200~600 mm;

He: the height of the tapered end of work rolls, in the range of 200~700 μm;

$a_0$, $a_1$, $a_2$, $a_3$, $a_4$: the coefficient of the rolls profile, in the range of:

$a_0$=100~500; $a_1$=−10~0; $a_2$=0.0001~0.1; $a_3$=E−10~E−20; $a_4$=−E−14~−E−20.

In service, the axial shifting amount of the work rolls is determined according the change of the width of the strip and the abrasion of the rolls so as to make the strip edge enter into a distance of the tapered end. The axial shifting amount of the work rolls is related to the width of the strip, the length of the tapered end of the work rolls, the length of the work roll body and the abrasion amount of the rolls, which can be represented by:

$$\text{Shift}=B/2+Le-Se-Lw/2$$

here:

Shift: the axial shifting amount of the work rolls;

B: the width of the strip, in the range of 1000~2000 mm;

Le: the length of tapered end of the work rolls;

Lw: the length of the work roll body, in the range of 1000~2500 mm;

Se: the length of the strip entering into the tapered end during rolling, which is related to the abrasion amount of rolls and can be calculated by f(Se)=Wc, here f: the function of the roll profile; Wc: the abrasion amount of the midpoint of work roll body.

In present invention, the roll profile is such that by grinding the end of the flat work rolls to a tapered end that can be represented by a quartic curve. The upper and lower rolls are located anti-symmetrically. The axial shifting of the work rolls is determined by the change of all the factors of the width of the strip and the abrasion of the work rolls and so on so as to make the edge of the strip enter into a distance of the tapered end. In the process of the continuous hot rolling of the broad strip, it can both control the edge drop of the strip and have some significant effects as follows:

(1) Because an end of the roll is tapered as quartic curve, and the transition between the tapered end and the roll body is smooth, asymmetric deformation due to the difference between abrasion of the upper and lower rolls is eliminated, which reducing wedged shape of the strip, and reducing unstable rolling due to asymmetrical strip stresses caused by the axial shifting of the roll.

(2) The axial shifting of the work roll is determined by the change of all the factors of the width of the strip and the abrasion of the work roll and so on. So the box shaped abrasion of conventional roll is eliminated, closed type abrasion of conventional roll is changed into open type abrasion, which averaging the abrasion of the rolls, eliminating "cat ear" hole, achieving flat toll type rolling, and fulfilling the equipment of free ruled rolling.

DESCRIPTION OF ILLUSTRATED EMBODIMENT

Figure 1:
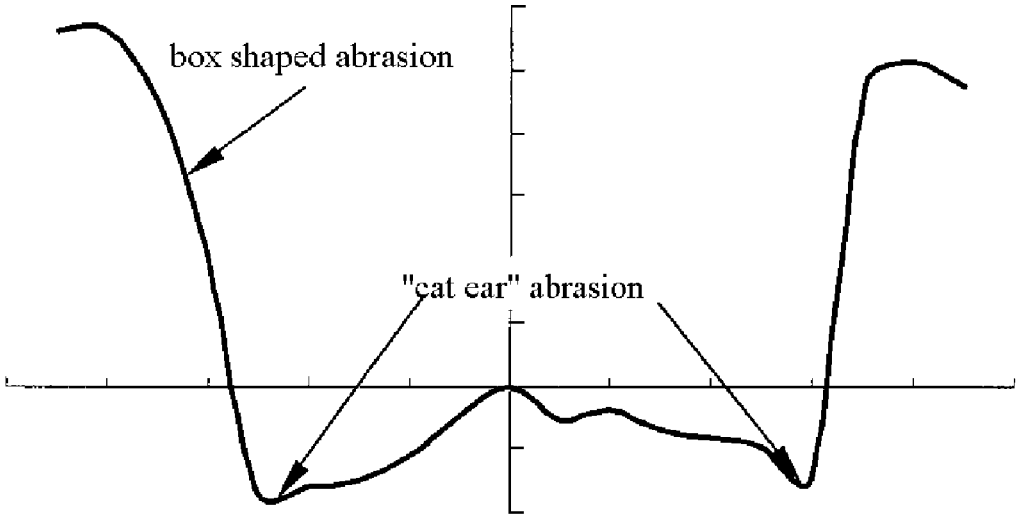
FIG. 1 is the schematic of the box shaped abrasion of conventional roll.
Figure 2:
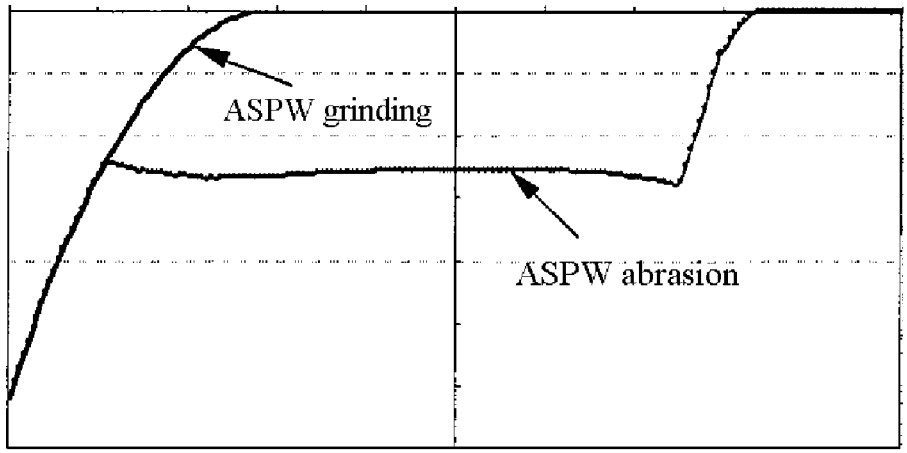
FIG. 2 is the schematic of the abrasion of work rolls according to present invention.
Figure 3:
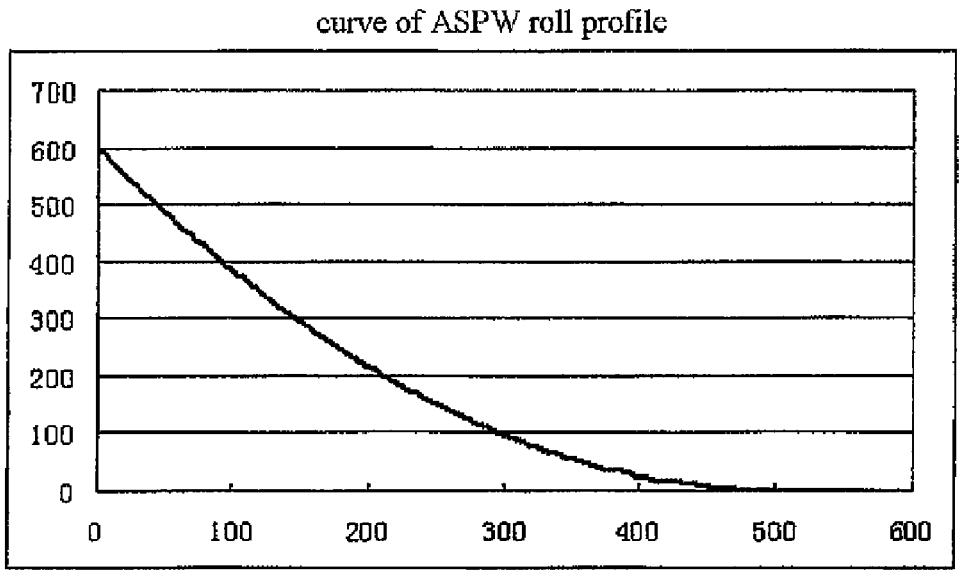
FIG. 3 is the coordinate graph of the roll profile for work rolls according to present invention.

Referring to FIG. 3, a roll profile for work rolls is provided for both shape control and free ruled rolling. Each of the work rolls is a roll having a tapered end. Providing starting point of the tapered end of the rolls being origin of coordinates, the curve of respective tapered end is a quartic curve represented by a formula as follows:

$$y(x)=a_0+a_1x+a_2x^2+a_3x^3+a_4x^4, \text{ wherein } x\in[0,Le],\ y(x)\in[0,He].$$

here:

Le: the length of the tapered end of work rolls, in the range of 200~600 mm;

He: the height of the tapered end of work rolls, in the range of 200~700 μm;

The length of the tapered end Le and the height of the tapered end He are determined by the standard of rolling;

$a_0$, $a_1$, $a_2$, $a_3$, $a_4$: the coefficient of the roll profile, in the range of:

$a_0$=100~500; $a_1$=−10~0; $a_2$=0.0001~0.1; $a_3$=E−10~E−20; $a_4$=−E−14~−E−20

Figure 4:
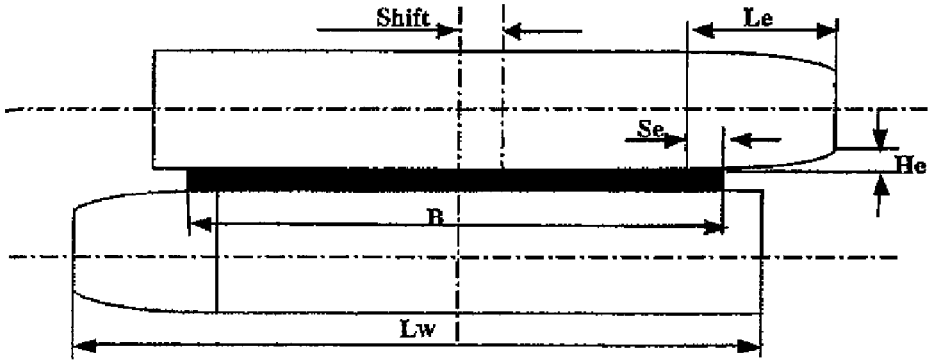
FIG. 4 is the working schematic and the roll profile for work rolls according to present invention.

As shown in FIG. 4, the roll profile of present invention is a type of technology for shape control in broad strip continuous hot rolling, whose main idea is grinding the edge of the flat work rolls to a tapered end which can be represented by quartic curve and positioning the upper and lower rolls anti-symmetrically, which in this text is named ASPW (Angang Strip Product Work Roll). In service, the axial shifting amount of the work rolls is determined according to the change of the width of the strip and the abrasion of the rolls so as to make the edge of the strip enter into a distance of the tapered end. The axial shifting amount of the work rolls is related to the width of strip, the length of the tapered end, the length of the work roll body and the abrasion amount of the rolls, which can be represented by:

$$\text{Shift}=B/2+Le-Se-Lw/2$$

here:

Shift: the axial shifting amount of the work rolls;

B: the width of the strip, in the range of 1000~2000 mm;

Le: the length of the tapered end of work rolls;

Lw: the length of work roll body, in the range of 1000~2500 mm;

Se: the length of the strip entering into the tapered end during rolling, which is related to the abrasion amount of the rolls and can be calculated by f(Se)=Wc, here f: the function of the roll profile; Wc: the abrasion amount of the midpoint of work roll body, the specific value thereof can be calculated from the model.

The invention can not only reduce the edge drop of the strip, but also improve the asymmetric deformation, average the abrasion of the rolls, eliminate "cat ear" hole, and achieve the free ruled rolling.

What is claimed is:

1. A roll profile for work rolls for both shape control and free ruled rolling, each of the work rolls being a roll having a tapered end, wherein providing an intersection point between the axial extending line of the maximum outer contour of the roll body and the extending line of the end surface of the tapered end being origin of coordinates, the curve of respective tapered end is represented by:

$$y(x)=a_0+a_1x+a_2x^2+a_3x^3+a_4x^4,\ x\in[0,Le],\ y(x)\in[0,He]$$

here:

x: the axial distance of the tapered curve;

y: the radial distance of said tapered curve;

Le: the length of the tapered end of work rolls, in the range of 200~600 mm;

He: the height of the tapered end of work rolls, in the range of 200~700 μm;

$a_0$, $a_1$, $a_2$, $a_3$, $a_4$: the coefficient of each order term of the roll profile, in the range of:

$a_0$=200~700; $a_1$=−10~0; $a_2$=0.0001~0.1; $a_3$=E−10~E−20; $a_4$=−E−14~−E−20.

2. The roll profile for work rolls for both shape control and free ruled rolling according to claim 1, wherein the axial The corresponding chart of the curve of ASPW roll profile

| related parameter | $a_0$ | $a_1$ | $a_2$ | $a_3$ | $a_4$ | Le | He |
|---|---|---|---|---|---|---|---|
| range of value | 100~800 | −10~0 | 0.0001~0.1 | E−10~E−20 | −E−14~−E−20 | 200~600 mm | 200~700 μm |
| value | 600 | 0.0024 | 0.0024 | 3E−17 | −3E−20 | 500 | 600 |
| point 1 of roll profile | X = 0 Y = 600 | | | | | | |
| point 2 of roll profile | X = 100 Y = 384 | | | | | | |
| point 3 of roll profile | X = 200 Y = 216 | | | | | | |
| point 4 of roll profile | X = 300 Y = 96 | | | | | | |
| point 4 of roll profile | X = 400 Y = 24 | | | | | | |
| point 5 of roll profile | X = 500 Y = 0 | | | | | | |

shifting amount of the work rolls is related to the width of the strip, the length of the tapered end, the length of the work roll body and the abrasion amount of the rolls, which is represented by:

$$\text{Shift}=B/2+Le-Se-Lw/2$$

here:

Shift: the axial shifting amount of the work roll;

B: the width of the strip, in the range of 1000~2000 mm;

Le: the length of the tapered end of work rolls; in the range of 200~600 mm;

Lw: the length of the work roll body, in the range of 1000~2500 mm;

Se: the length of an end of the strip positioned in the tapered end during rolling, which is related to the abrasion amount of the rolls and can be calculated by f(Se)=Wc, here f: a function of roll profile; Wc: the abrasion amount of the midpoint of axial length of the roll body.

* * * * *